US010113517B2

(12) United States Patent
Osawa et al.

(10) Patent No.: US 10,113,517 B2
(45) Date of Patent: Oct. 30, 2018

(54) AIR CLEANER FOR STRATIFIED SCAVENGING TWO-STROKE INTERNAL COMBUSTION ENGINE

(71) Applicant: YAMABIKO CORPORATION, Tokyo (JP)

(72) Inventors: Hisato Osawa, Tokyo (JP); Takahiro Yamazaki, Tokyo (JP); Hidekazu Tsunoda, Tokyo (JP); Yuuta Kobayashi, Tokyo (JP)

(73) Assignee: Yamabiko Corporation, Tokyo (JP)

( * ) Notice: Subject to any disclaimer, the term of this patent is extended or adjusted under 35 U.S.C. 154(b) by 150 days.

(21) Appl. No.: 15/189,012

(22) Filed: Jun. 22, 2016

(65) Prior Publication Data

US 2016/0377035 A1 Dec. 29, 2016

(30) Foreign Application Priority Data

Jun. 24, 2015 (JP) ..... 2015-127120

(51) Int. Cl.
*F02B 77/04* (2006.01)
*F02M 35/024* (2006.01)
(Continued)

(52) U.S. Cl.
CPC ..... *F02M 35/02433* (2013.01); *F02B 17/00* (2013.01); *F02B 25/14* (2013.01);
(Continued)

(58) Field of Classification Search
CPC ..... F02M 35/02433; F02M 35/02483; F02M 35/1017; F02M 35/1019; F02M 35/10196; F02M 35/108
(Continued)

(56) References Cited

U.S. PATENT DOCUMENTS 3,182,642 A * 5/1965 Drtina ..... F01P 1/02 123/41.35
3,907,529 A * 9/1975 Borsheim ..... B01D 45/12 55/337

(Continued)

FOREIGN PATENT DOCUMENTS

DE 102004056149 A1 5/2006
JP 2000170611 A 6/2000

OTHER PUBLICATIONS

Extended European Search Report received in corresponding European Patent Application No. 16176199.4 dated Dec. 8, 2016 (8 pages).

*Primary Examiner* — Marguerite McMahon
*Assistant Examiner* — Tea Holbrook
(74) *Attorney, Agent, or Firm* — Kilyk & Bowersox, P.L.L.C.

(57) ABSTRACT

To improve the effect of preventing contamination of an element in an air cleaner. An air cleaner includes a first inlet (60) through which air is fed to an intake system air passage and a second inlet (62) through which air is fed to an intake system air-fuel mixture passage. An extended passage (72) leads to the second inlet (62), for example. A passage forming member (70, 204) forming the extended passage (72) is shaped to surround a periphery of the first inlet (60). The passage forming member (70, 204) forms a blown-back fuel diffusion preventing region (74) leading to the first inlet (60).

14 Claims, 8 Drawing Sheets

(51) Int. Cl.

| | |
|---|---|
| ***F02B 17/00*** | (2006.01) |
| ***F02M 35/10*** | (2006.01) |
| ***F02B 25/14*** | (2006.01) |
| ***F02M 35/108*** | (2006.01) |
| ***F02B 25/20*** | (2006.01) |
| *F02B 75/02* | (2006.01) |
| *F02B 25/04* | (2006.01) |

(52) U.S. Cl.
CPC ..... *F02B 25/20* (2013.01); *F02M 35/024* (2013.01); *F02M 35/108* (2013.01); *F02M 35/1019* (2013.01); *F02M 35/10196* (2013.01); *F02B 25/04* (2013.01); *F02B 2075/025* (2013.01); *F02M 35/02483* (2013.01); *F02M 35/1017* (2013.01)

(58) Field of Classification Search
USPC ..... 123/198 E, 41.63, 41.65, 41.7; 55/345, 55/346, 385.1, 385.3
See application file for complete search history.

(56) References Cited

U.S. PATENT DOCUMENTS 4,028,076 A * 6/1977 Fields ..... B01D 45/16 55/337
4,619,677 A * 10/1986 Matheson ..... B01D 46/0005 210/304
4,765,282 A * 8/1988 Nagashima ..... B27B 17/00 123/41.67
4,783,207 A * 11/1988 Nagashima ..... B27B 17/00 123/198 E
5,059,221 A * 10/1991 McWilliam ..... F02M 35/021 123/198 E
5,503,649 A * 4/1996 Nickel ..... F02M 35/024 123/198 E
5,526,777 A * 6/1996 Taomo ..... B27B 17/00 123/198 E
5,918,576 A * 7/1999 Ohoka ..... F02B 61/02 123/198 E
D440,645 S * 4/2001 Coulonvaux ..... D23/364
6,314,922 B1 * 11/2001 Zimmermann ..... B25F 5/008 123/41.56
6,395,049 B2 * 5/2002 Knodler ..... F02M 17/04 123/198 E
6,425,930 B1 * 7/2002 Wake ..... B01D 46/0095 123/198 E
7,494,113 B2 2/2009 Eberhardt et al.
7,914,609 B2 * 3/2011 Sullivan ..... B01D 45/12 123/198 E
8,808,432 B2 * 8/2014 Rotter ..... F02M 35/022 55/337
2006/0107912 A1 5/2006 Hoche et al.
2007/0079794 A1 * 4/2007 Rotter ..... B01D 46/0004 123/198 E
2008/0120951 A1 5/2008 Sato et al.
2009/0235880 A1 * 9/2009 Ziegs ..... F01P 5/06 123/41.65
2009/0283079 A1 11/2009 Tsunoda
2013/0098325 A1 * 4/2013 Fukushima ..... F02M 17/34 123/184.23
2014/0026863 A1 * 1/2014 Sumi ..... F02M 59/14 123/495
2016/0376979 A1 12/2016 Osawa et al.

* cited by examiner

AIR CLEANER FOR STRATIFIED SCAVENGING TWO-STROKE INTERNAL COMBUSTION ENGINE

BACKGROUND OF THE INVENTION

The present application claims a priority from Japanese Patent Application No. 2015-127120, filed Jun. 24, 2015, which is incorporated herein by reference.

The present invention relates to an air cleaner incorporated in a stratified scavenging two-stroke internal combustion engine.

Two-stroke internal combustion engines are used as power sources for portable working machines such as a brush cutter, a chain saw, and a power blower.

U.S. Pat. No. 7,494,113 B2 discloses a stratified scavenging two-stroke internal combustion engine. A stratified scavenging engine, in a scavenging stroke, introduce air free of air-fuel mixture, namely fresh air, into a combustion chamber before introducing air-fuel mixture in a crankcase into the combustion chamber. The fresh air, which is introduced early in the scavenging stroke into the combustion chamber, is called "leading air".

An engine disclosed in U.S. Pat. No. 7,494,113 B2 has an intake system having two passages. A first passage is an "air passage". A second passage is an "air-fuel mixture passage". The fresh air, or the leading air, is fed to an engine body through the air passage. Air-fuel mixture is fed to the crankcase of the engine body through the air-fuel mixture passage.

The intake system disclosed in U.S. Pat. No. 7,494,113 B2 is constituted by an air cleaner, a carburetor, and an intake member connecting the carburetor and the engine body. The intake member has a first partition wall extending continuously in the longitudinal direction. The intake member has an air passage and an air-fuel mixture passage that are made independent from each other by the first partition wall.

The carburetor disclosed in U.S. Pat. No. 7,494,113 B2 has a throttle valve and a choke valve. The throttle valve and the choke valve are each formed by a butterfly valve. The throttle valve and the choke valve are in their fully opened positions while the machine is working at full throttle.

The carburetor disclosed in U.S. Pat. No. 7,494,113 B2 has a second partition wall dividing an internal gas passage of the carburetor into two passages. When the throttle valve and the choke valve are in the fully opened positions, these two valves and the second partition wall divide the internal passage of the carburetor into the air passage and the air-fuel mixture passage.

In this way, while the machine is working at full-throttle operating condition, air that has been cleaned by the air cleaner is fed to the crankcase through the air-fuel mixture passage as well as to the engine body through the air passage. The carburetor has a fuel nozzle in the air-fuel mixture passage. Fuel is sucked out through the fuel nozzle by air passing through the air-fuel mixture passage, and air-fuel mixture, that is, a mixture of fuel and air is generated within the air-fuel mixture passage in the carburetor.

U.S. Pat. No. 7,494,113 B2 discloses two types of carburetors. First and second types of carburetors are different from each other in their partition walls. In the first type of carburetor, the partition wall is shaped to divide, together with a fully opened throttle valve and a fully opened choke valve, the gas passage in the carburetor into two passages (FIG. 3 in U.S. Pat. No. 7,494,113 B2). That is to say, an intake system provided with the first type of carburetor has an air passage and an air-fuel mixture passage that are independent from each other, while the engine is operating under high speed rotation.

In the second type of carburetor, the partition wall is shaped similarly to that of the first type of carburetor but has a window formed by cutting away a part of the partition wall (FIG. 4 in U.S. Pat. No. 7,494,113 B2). The air passage and the air-fuel mixture passage in the second type of carburetor are in communication to each other all the time via the window. In other words, an intake system provided with the second type of carburetor has a window communicating with the air passage and the air-fuel mixture passage. The air passage and the air-fuel mixture passage of the intake system extend from the air cleaner to the engine body. In an intake system provided with the second type of carburetor, the air passage and the air-fuel mixture passage are partly in communication with each other all the time via the window, or the opening portion, while the engine is operating under high speed rotation.

Two-stroke internal combustion engines including the stratified scavenging two-stroke internal combustion engine have a problem of air cleaner contamination caused by blow-back of fuel. The fuel blow-back problem is caused not only by blow-back of air-fuel mixture from the air-fuel mixture passage, but also by blow-back of air from the air passage. It is natural that this problem is caused in an engine having the second type of carburetor. The problem is also caused in an engine having the first type of carburetor during acceleration or deceleration, or at half throttle.

Japanese Patent Laid-Open No. 2009-185633 proposes a measure to prevent contamination of an element due to blown-back fuel by effectively using the characteristics of stratified scavenging two-stroke internal combustion engines. Specifically, Japanese Patent Laid-Open No. 2009-185633 proposes an air cleaner for a stratified scavenging two-stroke internal combustion engine.

The air cleaner disclosed in Japanese Patent Laid-Open No. 2009-185633 has a first inlet through which clean air cleaned by an element is sent to an air passage of a carburetor and a second inlet through which the clean air is sent to an air-fuel mixture passage of the carburetor. The first and second inlets are independent from each other.

The air cleaner disclosed in Japanese Patent Laid-Open No. 2009-185633 has a guide member guiding blown-back fresh air from the air passage to the second inlet. That is, the guide member is positioned adjacent to the first inlet and the second inlet and is shaped such that it guides the blown-back fresh air from the first inlet to the second inlet. Thus shaped guide member also functions to receive air-fuel mixture from the second inlet.

The guide member inhibits diffusion of blown-back fresh air from the first inlet and blown-back air-fuel mixture from the second inlet in the air cleaner.

The present invention aims to prevent contamination of an element in an air cleaner incorporated in a stratified scavenging two-stroke internal combustion engine.

The present invention further aims to improve the effect of preventing the contamination of the element in the air cleaner disclosed in Japanese Patent Laid-Open No. 2009-185633.

The present invention further aims to provide an air cleaner used in a stratified scavenging two-stroke internal combustion engine that prevents contamination of an element due to blow-back of fresh air or air-fuel mixture from an intake system air passage or an intake system air-fuel mixture passage.

SUMMARY OF THE INVENTION

According to the present invention, the above technical problems can be achieved by providing an air cleaner (30, 200) for a stratified scavenging two-stroke internal combustion engine, the air cleaner including:

an element member (206) provided with a cleaner element (64) filtering air;

a first inlet (60) through which air filtered by the cleaner element (64) is drawn in and fed to an air passage in an intake system (6) of an engine (100);

a second inlet (62) which is located away from the first inlet (60) and through which air filtered by the cleaner element (64) is drawn in and fed to an air-fuel mixture passage in the intake system (6) of the engine (100); and a passage forming member (70, 204) forming an extended passage (72) leading to the first inlet (60) or the second inlet (62), wherein the passage forming member (70, 204) is shaped to surround a periphery of the first inlet (60) or the second inlet (62), and the passage forming member (70, 204) forms a blown-back fuel diffusion preventing region (74) leading to the first inlet (60) or the second inlet (62) independent from the extended passage (72).

Blow-back of fuel from the air passage or the air-fuel mixture passage in the engine intake system enters the air cleaner through the first inlet (60) or the second inlet (62). The passage forming member (70, 204) located to surround the first inlet (60) or the second inlet (62) prevents the blown-back fuel from diffusing in the air cleaner.

When the extended passage (72) is provided at the second inlet (62), blow-back of air-fuel mixture enters the extended passage (72) through the second inlet (62). The extended passage (72) is formed by the passage forming member (70), and thus this prevents fuel contained in the blown-back air-fuel mixture from diffusing in the air cleaner.

DETAILED DESCRIPTION OF THE PRESENT INVENTION

A preferable embodiment of the present invention will be described based on the attached drawings. The embodiment shows a typical example of the present invention in which an air-fuel mixture passage is extended, but the present invention can also be applied to extension of an air passage.

Figure 1:
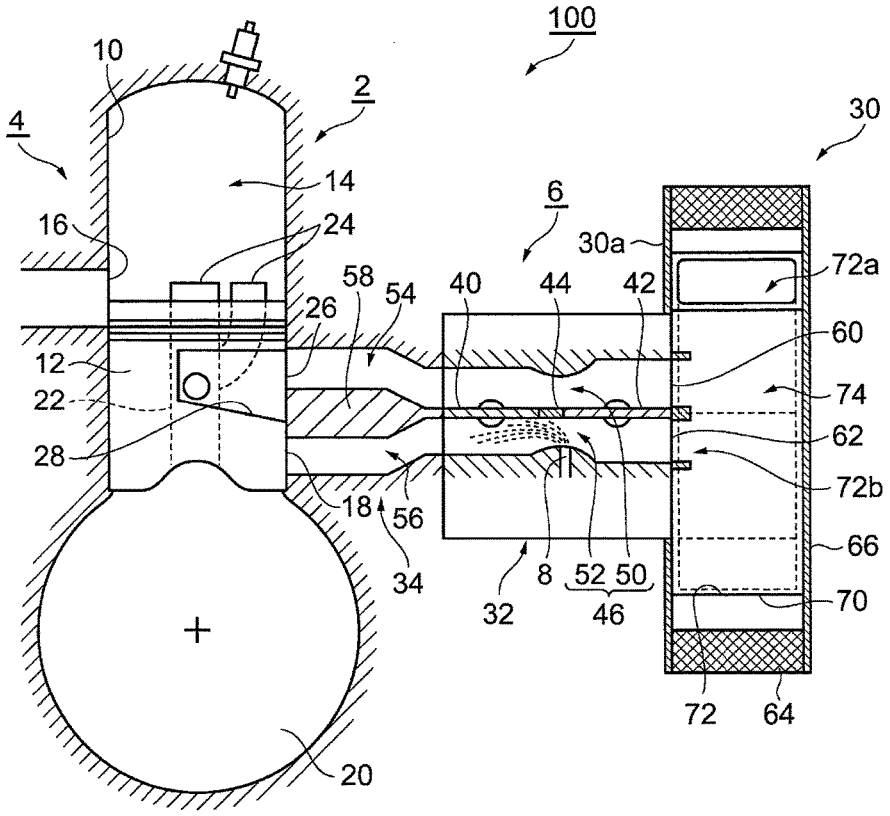
FIG. 1 illustrates the general outline of a stratified scavenging two-stroke engine incorporating an air cleaner according to the present invention.

FIG. 1 illustrates the general outline of a stratified scavenging two-stroke internal combustion engine incorporating an air cleaner according to the embodiment. Referring to FIG. 1, a reference numeral 100 denotes a stratified scavenging two-stroke internal combustion engine. The engine 100 is mounted on a portable working machine such as a brush cutter or a chain saw.

As can be seen from FIG. 1, the engine 100 is a single cylinder engine, and air cooled engine. The engine 100 has an engine body 2, an exhaust system 4, and an intake system 6.

The engine body 2 has a piston 12 fitted into a cylinder 10, and the piston 12 forms a combustion chamber 14. The piston 12 reciprocates in the cylinder 10. A reference numeral 16 denotes an exhaust port. The exhaust system 4 is connected to the exhaust port 16. A reference numeral 18 denotes an air-fuel mixture port. The air-fuel mixture port 18 leads to a crankcase 20 of the engine 100.

The cylinder 10 has scavenging passages 22 connecting the crankcase 20 to the combustion chamber 14. The scavenging passages 22 are in communication at one end with the crankcase 20 and at the other end with the combustion chamber 14 through scavenging ports 24.

The cylinder 10 also has an air port 26. Fresh air, or air free of air-fuel mixture, to be described later, is fed to the air port 26. The scavenging ports 24 are in communication with the air port 26 via a piston groove 28. That is to say, the piston 12 has a piston groove 28 on a circumferential surface thereof. The piston groove 28 is a recess formed on the circumferential surface of the piston 12, and has a function to temporarily store air.

The exhaust port 16, the air-fuel mixture port 18, the scavenging ports 24, and the air port 26 are opened and close by the piston 12. That is, the engine body 2 is of a so-called piston valve type. The communication between the piston groove 28 and the scavenging ports 24 and the communication between the piston groove 28 and the air port 26 are shut off by the operation of the piston 12. In other words, the reciprocation of the piston 12 controls communication and shut-off between the piston groove 28 and the scavenging ports 24, as well as controlling communication and shut-off between the piston groove 28 and the air port 26.

The intake system 6 is connected to the air port 26 and the air-fuel mixture port 18. The intake system 6 includes an air cleaner 30, a carburetor 32, and an intake member 34. The intake member 34 is made of a flexible material (elastic resin). The carburetor 32 is connected to the engine body 2 via the flexible intake member 34. The air cleaner 30 is fixed at an upstream end of the carburetor 32.

The carburetor 32 has a throttle valve 40 and a choke valve 42 located upstream of the throttle valve 40. The throttle valve 40 and the choke valve 42 are each formed by a butterfly valve. The carburetor 32 has a first partition wall 44. The throttle valve 40, the choke valve 42, and the first partition wall 44 form a first air passage 50 and a first air-fuel mixture passage 52 in an internal gas passage 46 of the carburetor 32 when the throttle valve 40 and the choke valve 42 are in the fully opened positions, that is, when the engine 100 is rotating at a high speed.

In FIG. 1, a reference numeral 8 denotes a main nozzle. Fuel is sucked out through the main nozzle 8 into the first air-fuel mixture passage 52 during mid-speed to high-speed rotation.

The intake member 34 interposed between the carburetor 32 and the engine body 2 has a second partition wall 58. The intake member 34 has a second air passage 54 and a second air-fuel mixture passage 56 located respectively on one side and the other side of the intake member 34 across the second partition wall 58.

The carburetor 32 may be connected to the engine body 2 by a first member provided with the second air passage 54 and a second member that is separate from the first member and provided with the second air-fuel mixture passage 56, instead of by the intake member 34 provided with the second air passage 54 and the second air-fuel mixture passage 56.

As can be seen from the foregoing description, the first air passage 50 in the carburetor 32 together with the second air passage 54 of the intake member 34 form the air passage of the intake system 6, downstream of the air cleaner 30. The other, air-fuel mixture passage of the intake system is formed by the first air-fuel mixture passage 52 in the carburetor 32 and the second air-fuel mixture passage 56 of the intake member 34.

The air cleaner 30 has a first inlet 60 and a second inlet 62, which are independent from each other. External air is cleaned by a cleaner element 64 to produce clean air. The clean air enters the intake system air passage through the first inlet 60 and enters the intake system air-fuel mixture passage through the second inlet 62.

In the air cleaner 30, a passage forming member 70 is connected to the second inlet 62, that is, an inlet leading to the intake system air-fuel mixture passage. The passage forming member 70 has an extended air-fuel mixture passage 72. The extended air-fuel mixture passage 72 has an entrance opening 72*a* and an exit opening 72*b*. Part of air cleaned by the cleaner element 64 enters the extended air-fuel mixture passage 72 through the entrance opening 72*a*. Then, the air passing through the extended air-fuel mixture passage 72 enters the second inlet 62 through the exit opening 72*b*.

Figure 2:
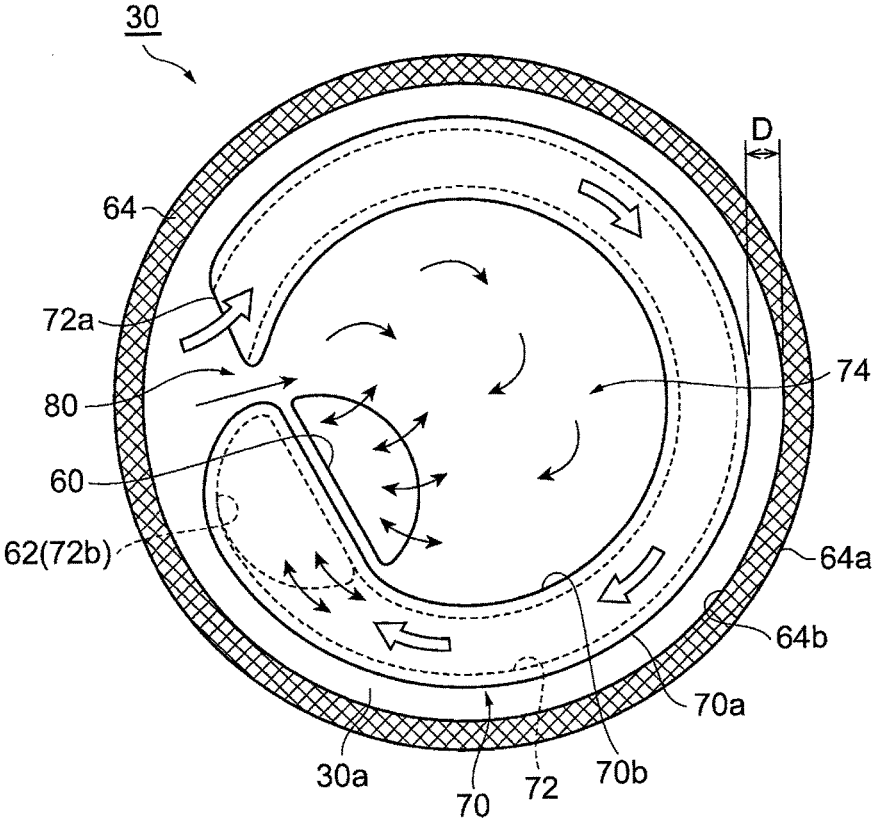
FIG. 2 is a plan view of the air cleaner of the present invention with a ceiling plate member removed to show the inner construction of the air cleaner, illustrating the general outline of the air cleaner.

The passage forming member 70 is shaped to surround a periphery of the first inlet 60 leading to the intake system air passage. FIG. 2 is a plan view of the air cleaner 30.

Referring to FIG. 2, the air cleaner 30 has a circular shape as seen in a plan view, and the element 64 is arranged on a base 30*a* of the air cleaner 30. The element 64 has a circular ring shape as seen in a plan view, and an outer circumferential surface 64*a* of the cleaner element 64 forms an outer circumferential surface of the air cleaner 30.

The passage forming member 70 has an arc shape as seen in a plan view. The passage forming member 70 is arranged inwardly of an inner circumferential surface 64*b* of the element 64. An outer circumferential surface 70*a* of the passage forming member 70 and the inner circumferential surface 64*b* of the cleaner element 64 are spaced apart from each other. A distance between the passage forming member 70 and the inner circumferential surface 64*b* of the cleaner element 64 is denoted by a reference character "D".

As can be seen from FIG. 2, the first inlet 60 and the second inlet 62 are separately open to an inner space of the air cleaner 30. The first inlet 60 and the second inlet 62 are located adjacent to each other. The first inlet 60 leading to the intake system air passage is located on the inner side of the air cleaner base 30*a*, and the second inlet 62 leading to the intake system air-fuel mixture passage is located on the outer side of the air cleaner base 30*a*.

The passage forming member 70 attached to the second inlet 62 extends in a circumferential direction along an outer circumferential portion of the air cleaner base 30*a*. The entrance opening 72*a* of the extended air-fuel mixture passage 72 of the passage forming member 70 is located close to the exit opening 72*b*, or the second inlet 62.

The periphery of the first inlet 60 leading to the intake system air passage is surrounded by the passage forming member 70. The passage forming member 70 forms a peripheral wall surface 70*b* that defines a blown-back fuel diffusion preventing region 74 leading to the first inlet 60.

The cleaner element 64 has the circular ring shape as described above. Clean air filtered by the cleaner element 64 is reserved in a space surrounded by the element 64. The space surrounded by the element 64 is called an "air cleaner clean space". The first and second inlets 60 and 62 are open to the air cleaner clean space.

The element 64 has a ceiling plate member 66 (FIG. 1) that defines a ceiling wall of the air cleaner 30. The ceiling plate member 66, which is opposed to the air cleaner base 30*a*, closes the blown-back fuel diffusion preventing region 74. In other words, the blown-back fuel diffusion preventing region 74 is defined by the air cleaner base 30*a*, the peripheral wall surface 70*b* (FIG. 2) of the passage forming member 70, and the ceiling plate member 66.

Part of air cleaned by the cleaner element 64 enters the extended air-fuel mixture passage 72 through the entrance opening 72*a* of the passage forming member 70 (the extended air-fuel mixture passage 72), and then passes through the extended air-fuel mixture passage 72 and enters the intake system air-fuel mixture passage through the exit opening 72*b* and the second inlet 62.

Part of air cleaned by the cleaner element 64 enters the blown-back fuel diffusion preventing region 74 through a first clearance gap 80 (FIG. 2) between the entrance opening 72*a* and the exit opening 72*b* of the passage forming member 70 (the extended air-fuel mixture passage 72). Then, the air enters the intake system air passage through the first inlet 60. In other words, the blown-back fuel diffusion preventing region 74 is opened to the air cleaner clean space through the first clearance gap 80.

During operation of the engine 100, blow-back of air-fuel mixture through the intake system air-fuel mixture passage enters the passage forming member 70. Fuel components and oil components contained in the blown-back air-fuel mixture adhere to wall surfaces of the relatively long passage forming member 70. This prevents the contamination of the cleaner element 64 by the blown-back air-fuel mixture.

During operation of the engine 100, the inner circumferential wall of the passage forming member 70 inhibits diffusion of the blown-back air that has been flowed back through the intake system air passage. That is, the blown-back air is trapped in the blown-back fuel diffusion preventing region 74. This prevents the contamination of the cleaner element 64 that is otherwise caused by the air-fuel mixture and the oil components that can be contained in the blown-back air.

The ceiling plate member 66 forming the ceiling wall of the blown-back fuel diffusion preventing region 74 may be integral with or separate from the element 64.

The shape of the passage forming member 70 as seen in a plan view is not limited to circle. It may have an elliptical or polygonal shape. The term "polygonal" is not limited to the geometric sense. It means a shape having corners. The corners are preferably rounded. The passage forming member 70 preferably has no turns like hairpin turns. The length of the passage forming member 70 may be a half circle or three-fourths of circle, for example.

In the example in FIG. 2, air is introduced into the blown-back fuel diffusion preventing region 74 through the first clearance gap 80 between one and the other ends of the passage forming member 70. In other words, the blown-back fuel diffusion preventing region 74 is opened to the "air cleaner clean space" through the first clearance gap 80. The first clearance gap 80 may be set to any size by changing the length and the shape of the passage forming member 70 as described above. An amount of air to be introduced into the blown-back fuel diffusion preventing region 74 may be adjusted by using a second clearance gap between the passage forming member 70 and the ceiling plate member 66. In other words, the blown-back fuel diffusion preventing region 74 may be opened to the "air cleaner clean space" through the second clearance gap. The second clearance gap may span the entire or a part of the longitudinal length of the passage forming member 70.

The extended air-fuel mixture passage 72 of the passage forming member 70 most preferably has the same effective cross-sectional area at any point in the longitudinal direction. Of course, the effective cross-sectional area may be varied to an acceptable degree.

Referring to FIG. 2, the first inlet 60 leading to the intake system air passage is located inwardly of the second inlet 62 leading to the intake system air-fuel mixture passage. The second inlet 62 has the passage forming member 70 attached thereto. Looking at a portion of the passage forming member 70 at the second inlet 62, that is, a portion of the passage forming member 70 (the extended air-fuel mixture passage 72) at the exit opening 72*b*, the portion forms a reflective wall that is adjacent to the first inlet 60. Thus, the portion of the passage forming member 70 at the exit opening 72*b* forms the reflective wall against the blown-back air coming out of the first inlet 60. The reflective wall effectively blocks diffusion of the blown-back air coming out of the first inlet 60, toward the element 64. That is to say, the reflective wall reflects the blown-back air toward the blown-back fuel diffusion preventing region 74.

Figure 3:
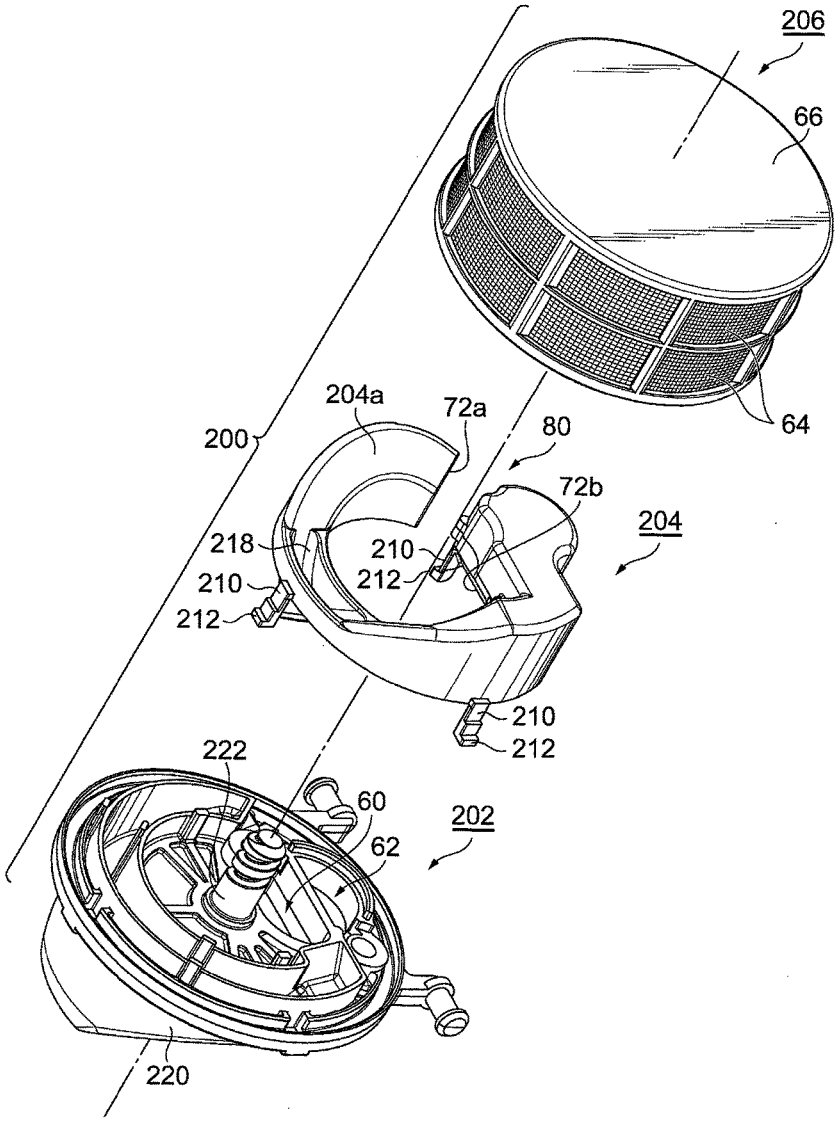
FIG. 3 is an exploded perspective view of the air cleaner of an embodiment.

FIGS. 3 to 8 show the embodiment. In the following description of the embodiment, the same components as those in the foregoing description will be denoted by the same reference characters and the explanations thereof will be appropriately omitted. FIG. 3 is an exploded perspective view of an air cleaner 200 in the embodiment. The air cleaner 200 is constituted by an air cleaner base 202, a passage forming member 204 and an element member 206.

The air cleaner base 202 and the passage forming member 204 are moldings made of synthetic resin. The element member 206 includes the ring-shaped element 64 and the ceiling plate member 66, and the cleaner element 64 is formed by a filtering material such as a mesh material.

Figure 4:
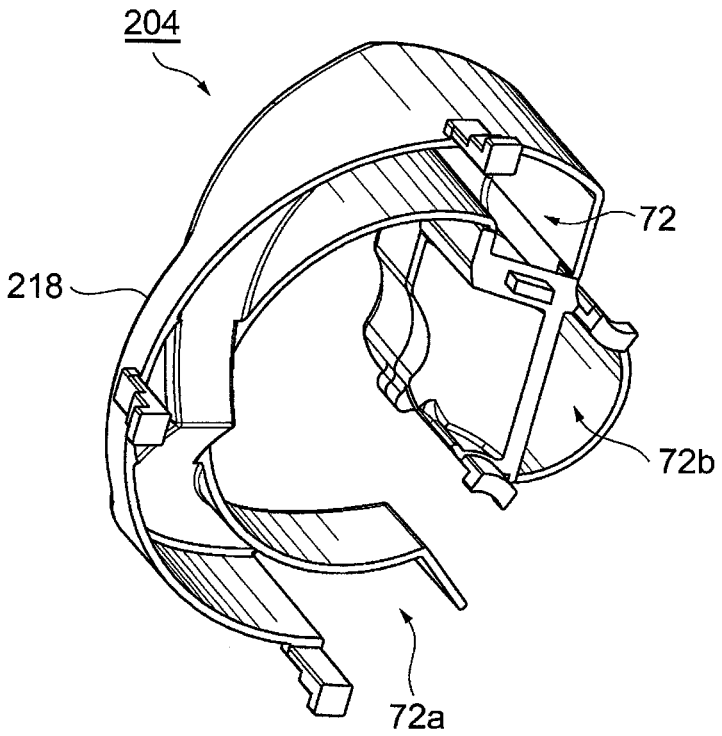
FIG. 4 is a perspective view of a passage forming member included in the air cleaner of the embodiment.

The passage forming member 204 has a plurality of legs 210, and the legs 210 each has a claw 212 at an end. The passage forming member 204 is fixed to the air cleaner base 202 by using the claw legs 210. The passage forming member 204 has a U-shaped cross-section that is opened toward the air cleaner base 202, and forms the extended air-fuel mixture passage 72 together with the air cleaner base 202. FIG. 4 is a perspective view of the passage forming member 204.

The passage forming member 204 is located adjacent to the cleaner element 64, which has a circular shape in a plan view. The passage forming member 204 has an arc shape in a plan view and extends along almost the entire length of the cleaner element 64. The passage forming member 204 is capable of rectifying air passing therethrough because of the long, arc shape.

Figure 5:
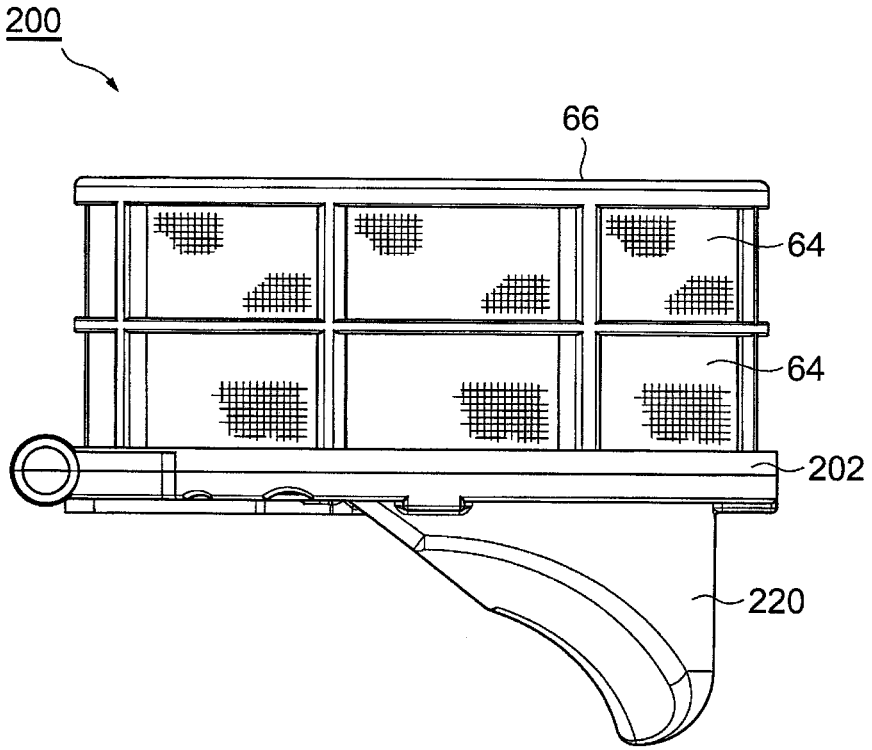
FIG. 5 is a side view of the air cleaner of the embodiment.

As can be seen from FIG. 3, a ceiling wall 204*a* of the passage forming member 204 is curved in a wave shape. The air cleaner base 202 has a convex portion 220 (FIG. 3) protruding toward the carburetor 32 (FIG. 1), in correspondence with the concave portion 218 of the ceiling wall 204*a*. The convex portion 220 is located in an area where it forms the extended air-fuel mixture passage 72 together with the passage forming member 204, as a result, the extended air-fuel mixture passage 72 has a substantially constant effective cross-sectional area along the entire length. FIG. 5 is a side view of the air cleaner 200.

Figure 6:
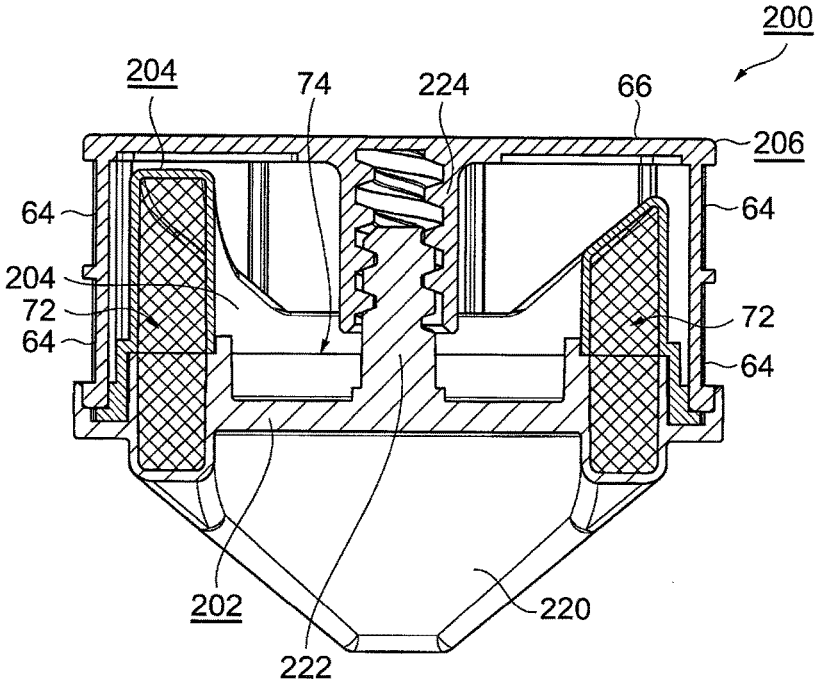
FIG. 6 is a vertical cross-sectional view of the air cleaner of the embodiment cut along a diameter of the air cleaner.

FIG. 6 s a vertical cross-sectional view of the air cleaner 200. Referring to FIG. 6, the air cleaner base 202, which has a circular shape in a plan view, has a threaded rod 222 standing at the center of the base 202. The element member 206, which has a circular shape in a plan view, has a boss 224 at the center of the ceiling plate member 66. The element member 206 is fixed to the air cleaner base 202 by screwing the threaded rod 222 into the boss 224. The portion shaded by crossed diagonal lines in FIG. 6 shows the extended air-fuel mixture passage 72.

Figure 7:
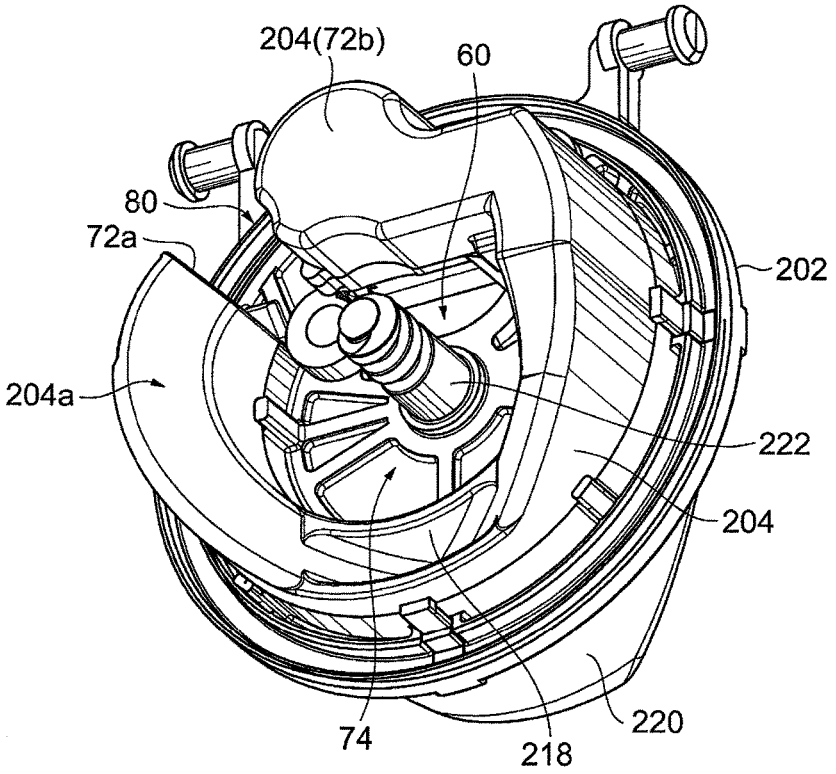
FIG. 7 is a perspective view of the air cleaner of the embodiment with an element member removed.
Figure 8:
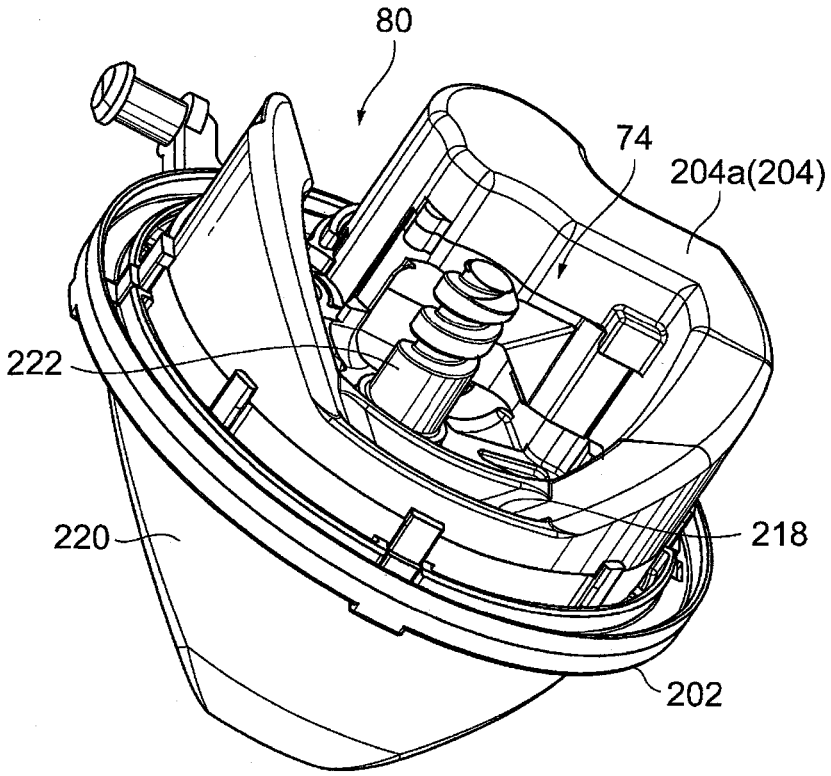
FIG. 8 is a perspective view of the air cleaner of the embodiment with the element member removed, as seen in a direction different from that in FIG. 7.

FIGS. 7 and 8 each shows the passage forming member 204 attached to the air cleaner base 202. That is, FIGS. 7 and 8 each shows the air cleaner 200 before the element member 206 is attached thereto. The concave portion 218 of the passage forming member 204 is formed diametrically opposite to the first inlet 60 leading to the intake system air passage.

The blown-back fuel diffusion preventing region 74 defined by the passage forming member 204 is opened outwardly through two parts. A first part is the first clearance gap 80 between the entrance opening 72*a* and the exit opening 72*b* of the passage forming member 204 (the extended air-fuel mixture passage 72). A second part is the concave portion 218 of the passage forming member 204 as described above, the concave portion 218 is located diagonally opposite to the first inlet 60, that is, substantially opposite to the first clearance gap 80. Air cleaned by the element 64 enters the blown-back fuel diffusion preventing region 74 through these two parts, and enters the intake system air passage through the first inlet 60.

The preferable embodiment of the present invention has been described. An air cleaner according to the present invention is suitably applied to a stratified scavenging engine in the form of the disclosure in U.S. Pat. No. 7,494,113 B2. As in the foregoing description, the engine disclosed in U.S. Pat. No. 7,494,113 B2 has a partition wall in the carburetor. The partition wall substantially partitions the engine intake system into the air passage and the air-fuel mixture passage when the throttle valve is in its fully opened position.

Referring to FIG. 1, a modification of the first partition wall 44 in the carburetor 32 may be a partition wall that is partially cut out. A suitable example of the partition wall is disclosed in FIG. 4 of U.S. Pat. No. 7,494,113 B2. That is, the air cleaner of the present invention can be suitably applied to an engine provided with the second type of carburetor described above. Thus, in a two-stroke engine, contamination of a cleaner element is prevented while maintaining a high delivery ratio.

The second type of carburetor has the window in the partition wall in the carburetor, so that the intake system air passage and the intake system air-fuel mixture passage are in communication with each other all the times. The window may be formed at any portion of the engine intake system.

The above embodiment has shown the case where the intake system air-fuel mixture passage is extended, while the present invention is not limited to this. The present invention can be suitably applied to extension of the intake system air passage, instead of the extension of the intake system air-fuel mixture passage. When the passage forming member

70 is provided at the first inlet 60 for extending the intake system air passage, the location of the first inlet 60 and the second inlet 62 may be reversed so that the first inlet 60 is formed outwardly of the second inlet 62.

REFERENCE SIGNS LIST

100 Stratified scavenging engine
6 Intake system
12 Piston
14 Combustion chamber
18 Air-fuel mixture port
20 Crankcase
22 Scavenging passage
30 air cleaner
30*a* Air cleaner base
60 First inlet
62 Second inlet
64 Cleaner element
66 Ceiling plate member of cleaner element
70 Passage forming member
72 Extended air-fuel mixture passage
72*a* Entrance opening of extended air-fuel mixture passage
72*b* Exit opening of extended air-fuel mixture passage
74 Blown-back fuel diffusion preventing region
80 Clearance gap between entrance opening and exit opening of passage forming member
200 Air cleaner in embodiment
202 Air cleaner base
204 Passage forming member
204*a* Ceiling wall of passage forming member
206 Element member

What is claimed is:

1. An air cleaner for a stratified scavenging two-stroke internal combustion engine, wherein the air cleaner is connected to a carburetor with an air passage and an air-fuel mixture passage to supply clean air filtered by the air cleaner to the air passage and the air-fuel mixture passage of the carburetor, the air cleaner comprising:

an element member provided with a cleaner element for filtering air, an outer circumferential surface of the cleaner element forming an outer circumferential surface of the air cleaner;

an air cleaner base having a first inlet and a second inlet;

a ceiling plate member opposed to the air cleaner base to define a ceiling wall of the air cleaner and;

an air cleaner clean space formed by the air cleaner base, the ceiling plate member and the cleaner element;

a passage forming member forming an extended passage leading to the second inlet, wherein the passage forming member is shaped to surround a periphery of the first inlet, and wherein the passage forming member forms a blown-back fuel diffusion preventing region leading to the first inlet, wherein the blown-back fuel diffusion preventing region is closed by the air cleaner base and the ceiling plate member, and defined by the air cleaner base, the ceiling plate member and a peripheral wall surface of the passage forming member, wherein the passage forming member has an entrance opening at one end in a longitudinal direction of the passage forming member and an exit opening at another end of the passage forming member, wherein the entrance opening is opened to the air cleaner clean space, and the exit opening is connected to the second inlet, wherein the blown-back fuel diffusion preventing region is opened to an air cleaner clean space that is defined by the cleaner element and outside of the passage forming member, and the blown-back fuel diffusion preventing region is opened to the air cleaner clean space through a clearance gap between the entrance opening and the exit opening, wherein the first inlet is connected to one of the air passage and the air-fuel mixture passage, the second inlet is connected to the other of the air passage and the air-fuel mixture passage.

2. The air cleaner for a stratified scavenging two-stroke internal combustion engine of claim 1, wherein the first inlet is located inwardly of the second inlet.

3. The air cleaner for a stratified scavenging two-stroke internal combustion engine of claim 2, wherein a ceiling wall of the passage forming member has a concave portion, and the blown-back fuel diffusion preventing region is opened to the air cleaner clean space through the concave portion.

4. The air cleaner for a stratified scavenging two-stroke internal combustion engine of claim 3, wherein the extended passage has no turns.

5. The air cleaner for a stratified scavenging two-stroke internal combustion engine of claim 4, wherein the passage forming member extends for an entire circumference of the periphery of the first inlet.

6. The air cleaner for a stratified scavenging two-stroke internal combustion engine of claim 5, wherein the exit opening of the passage forming member is located adjacent to the first inlet, the exit opening of the passage forming member forms a reflective wall that is adjacent to the first inlet, the reflective wall reflects blown-back fuel coming out of the first inlet toward the blown-back fuel diffusion preventing region.

7. The air cleaner for a stratified scavenging two-stroke internal combustion engine of claim 2, wherein the extended passage has no turns.

8. The air cleaner for a stratified scavenging two-stroke internal combustion engine of claim 7, wherein the passage forming member extends for an entire circumference of the periphery of the first inlet.

9. The air cleaner for a stratified scavenging two-stroke internal combustion engine of claim 8, wherein the exit opening of the passage forming member is located adjacent to the first inlet, the exit opening of the passage forming member forms a reflective wall that is adjacent to the first inlet, the reflective wall reflects blown-back fuel coming out of the first inlet toward the blown-back fuel diffusion preventing region.

10. The air cleaner for a stratified scavenging two-stroke internal combustion engine of claim 2, wherein the passage forming member extends for an entire circumference of the periphery of the first inlet.

11. The air cleaner for a stratified scavenging two-stroke internal combustion engine of claim 10, wherein the exit opening of the passage forming member is located adjacent to the first inlet, the exit opening of the passage forming member forms a reflective wall that is adjacent to the first inlet, the reflective wall reflects blown-back fuel coming out of the first inlet toward the blown-back fuel diffusion preventing region.

12. The air cleaner for a stratified scavenging two-stroke internal combustion engine of claim 1, wherein the extended passage has no turns.

13. The air cleaner for a stratified scavenging two-stroke internal combustion engine of claim 12, wherein the passage forming member extends for an entire circumference of the periphery of the first inlet.

14. The air cleaner for a stratified scavenging two-stroke internal combustion engine of claim 13, wherein the exit opening of the passage forming member is located adjacent to the first inlet, the exit opening of the passage forming member forms a reflective wall that is adjacent to the first inlet, the reflective wall reflects blown-back fuel coming out of the first inlet toward the blown-back fuel diffusion preventing region.

* * * * *